US005551215A

United States Patent [19]

McDonald et al.

[11] Patent Number: 5,551,215

[45] Date of Patent: Sep. 3, 1996

[54] BAG AND METHOD OF OPENING A BAG WITH PARTIAL OFFSET LIP

[75] Inventors: Gregory E. McDonald; Andrew W. Moehlenbrock, both of Simpsonville; John D. Foster, Campobello, all of S.C.

[73] Assignee: W. R. Grace & Co.-Conn., Duncan, S.C.

[21] Appl. No.: 372,084

[22] Filed: Jan. 13, 1995

[51] Int. Cl.[6] ..... B65B 43/26

[52] U.S. Cl. ..... 53/459; 53/570; 53/492

[58] Field of Search ..... 53/459, 469, 570, 53/567, 284.7, 250, 384.1, 381.7, 460, 569, 284.3, 492, 571, 572; 383/35, 37

[56] References Cited

U.S. PATENT DOCUMENTS

| | | | |
|---|---|---|---|
| 997,193 | 7/1911 | Hoyt . | |
| 2,601,480 | 6/1952 | Williams | 226/49 |
| 2,914,895 | 2/1959 | Martin | 53/250 |
| 3,059,550 | 10/1962 | Wellman | 93/29 |
| 3,501,888 | 3/1970 | Egli et al. | 53/86 |
| 3,552,090 | 1/1971 | Roberts et al. | 53/570 |
| 3,740,922 | 6/1973 | Liou | 53/188 |
| 3,804,322 | 4/1974 | Ericson | 229/53 |
| 4,484,904 | 11/1984 | Fowler | 383/35 |
| 4,516,384 | 5/1985 | Imperiale | 53/570 |
| 4,795,413 | 1/1989 | Johnson et al. | 493/309 |

*Primary Examiner*—John Sipos
*Assistant Examiner*—John Paradiso
*Attorney, Agent, or Firm*—Mark B. Quatt

[57] ABSTRACT

A method of opening a bag includes the steps of providing a bag having a first lip and a second lip defining a substantially flat bag opening, the first lip being secured to adhesive strips for positioning the bag and the second lip having an extending portion extending beyond the first lip; and applying a force to the extending portion of the second lip of the bag so as to displace the second lip away from the first lip, thereby opening the bag opening.

7 Claims, 5 Drawing Sheets

BAG AND METHOD OF OPENING A BAG WITH PARTIAL OFFSET LIP

The invention relates to a method of opening a bag and a bag opening system for opening bags having an offset or cutout lip.

Bags of various materials and structures are frequently used in the packaging of food and other items. Numerous patents exist which deal with the problem of opening the bag prior to inserting the product to be packaged. The need still exists, however, for a simple, reliable and effective method and system for opening bags.

It is therefore a principal object of the present invention to provide a reliable method of opening a bag.

It is a further object of the invention to provide a method of opening a bag which avoids the use of air pressure or vacuum to open the bag.

It is a still another object of the invention to provide a method of opening a bag which is useful with side seal and end seal bags.

It is another object of the invention to provide a method of opening a bag which reduces or minimizes the effect of stuck together bag openings.

It is still another object of the invention to provide a system for performing the method of opening bags according invention.

Other objects and advantages will appear hereinbelow.

SUMMARY OF THE INVENTION

In accordance with the invention, the foregoing objects and advantages are readily attained.

According to the invention, a method of opening a bag is provided which comprises the steps of: providing a bag having a first lip and a second lip defining a substantially flat bag opening, said first lip being secured to means for positioning said bag and said second lip having an extending portion extending beyond said first lip; and applying a force to said extending portion of said second lip of said bag so as to displace said second lip away from said first lip, thereby opening said bag opening.

In further accordance with the invention, a bag opening system is provided which comprises: a plurality of bags, each bag having a first lip and a second lip defining a substantially flat bag opening, said second lip having an extending portion extending beyond said first lip; means for positioning said plurality of bags in a row, said bags being positioned with said first lip attached to said positioning means and with said bag opening positioned transverse to said row; opening means for contacting said extending portion of said second lip so as to displace said second lip away from said first lip and open said bag opening; and means for advancing said positioning means so as to advance said plurality of bags to said opening means.

BRIEF DESCRIPTION OF THE DRAWINGS

A detailed description of preferred embodiments of the invention follows with reference to the attached drawings wherein.

DETAILED DESCRIPTION

The invention relates to a method and system of opening a bag for the packaging of food and other products in the bag.

Figure 1:
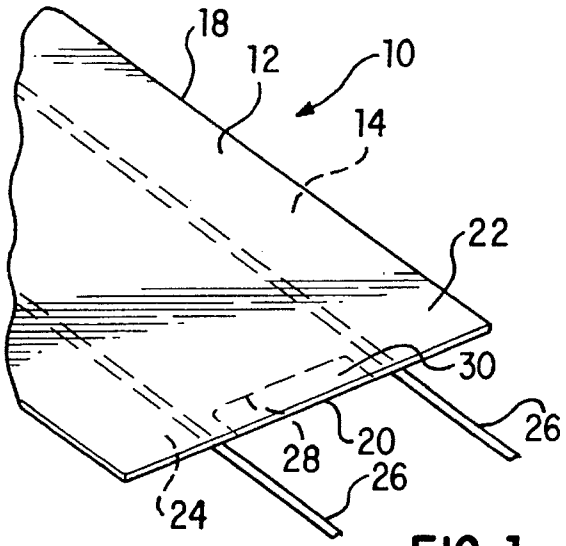
FIG. 1 is a perspective view of a first embodiment of a bag positioned on adhesive strips of tape according to the invention.

Referring to FIG. 1, bags 10 to be opened in accordance with the method and system of the present invention are substantially flat and have an upper layer or side wall 12 and a lower layer or side wall 14. Layers 12, 14 are joined to each other at a bottom edge 16 and side edges 18 thereof. Layers 12, 14 have upper and lower lip portions 22, 24 respectively which serve to define an open top edge or bag opening 20 of bag 10. According to the invention, bags 10 are initially provided in a substantially flat condition as shown. Bag opening 20 of bag 10 is opened according to the invention so that bag 10 may be loaded with a product or for any other desired procedure in which it is desired to open bag opening 20.

Still referring to FIG. 1, bags 10 according to the invention are positioned on adhesive tape or strips 26, preferably on two substantially parallel spaced strips 26 as shown. Strips 26 are advanced so as to transport bags 10 along a substantially horizontal or vertical path for individual opening according to the invention, and subsequent loading and/or sealing steps and the like.

According to the invention, bags 10 are positioned with bag opening 20 arranged at a leading edge of bag 10 with respect to the direction of advance (indicated by arrow A in FIG. 1) of bags 10 and strips 26. Bags 10 are positioned in an end seal arrangement with bag opening 20 of each bag 10 arranged substantially transverse to the direction of advance as shown. Bags 10 are removably adhered to strips 26 so that bags 10 may be either removed from the strips and loaded or alternately after opening and insertion of product, readily removed from strips 26 as desired for further processing according to conventional techniques.

Any suitable motive means 27 may be provided, as shown schematically in FIGS. 5–8, for advancing strips 26 and bags 10 positioned thereon in accordance with the invention.

Adhesive strips 26 may be made from any suitable flexible material, and provided with any adhesive sufficient to hold lower layer 14 in place during lifting of upper layer 12 and opening of bag 10. The adhesive is also preferably sufficiently releasable so as to permit removal of bags 10 from strips 26 after opening and loading.

Figure 4:
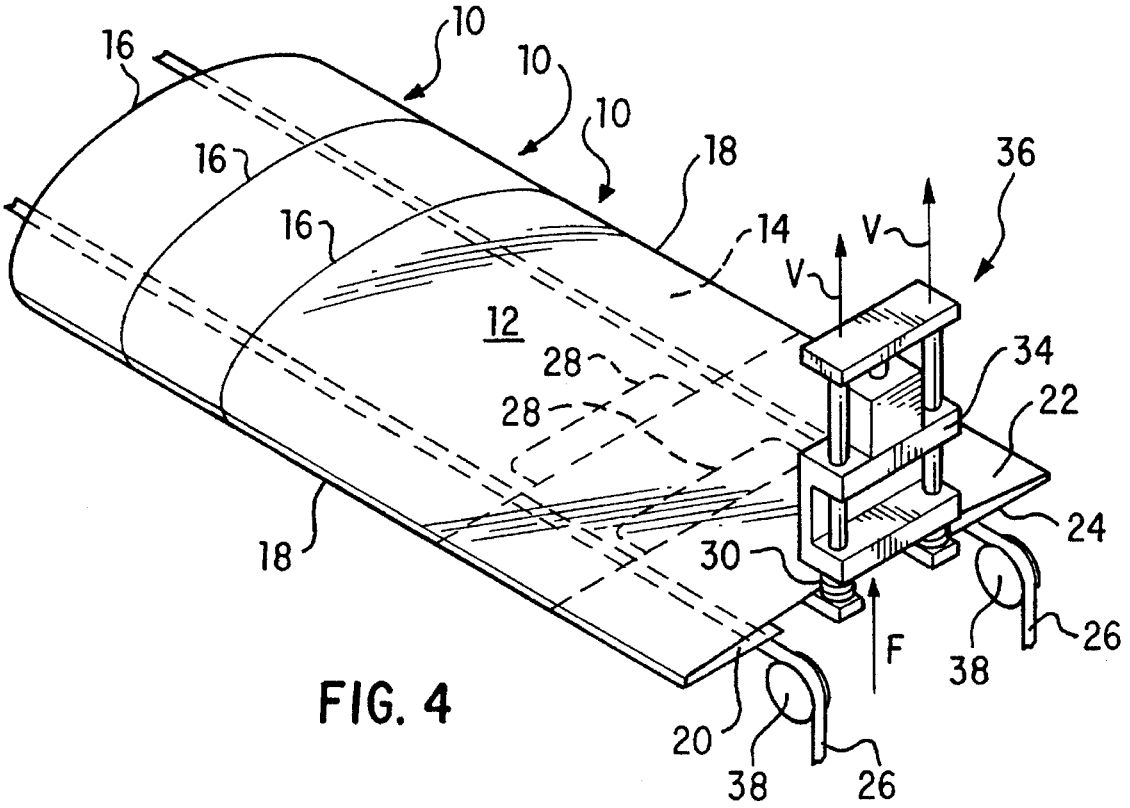
FIG. 4 is a perspective view of the bag opening system of FIG. 3 with a bag in an open position.

According to the invention, a plurality of bags are provided on strips 26, arranged in a row and partially overlapping as shown in FIG. 4. Bags 10 may thereby be advanced toward an opening station generally referred to by reference numeral 36 so as to position bags 10 one at a time for opening at station 36. For simplicity, only a single bag 10 is illustrated in the other drawings.

In accordance with the invention, lower layer 14 is removably adhered to strips 26 and has a cutout 28 arranged in lower lip portion 24 thereof so as to provide an extending portion 30 of upper lip portion 22 at bag opening 20 where upper lip portion 22 is exposed or offset relative to lower lip portion 24.

Figure 2:
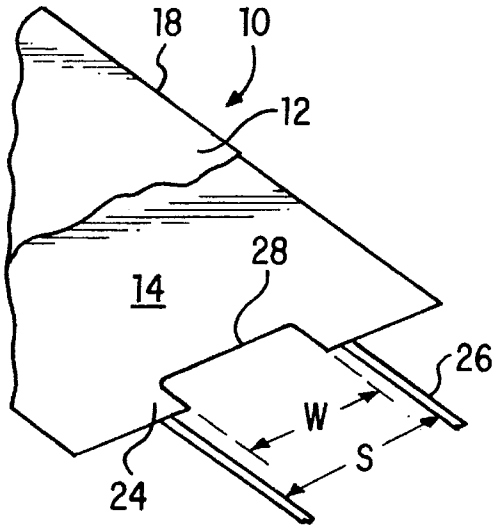
FIG. 2 is a partially sectional view similar to FIG. 1.

FIG. 2 has a portion of upper layer 12 sectioned away so as to better illustrate cutout 28 in lower layer 14 according to the invention. Cutout 28 according to the invention preferably has a width W which is less than the spacing S of strips 26 so that upper layer 12 is not also adhered to strips 26. Of course, cutout 28 could alternatively be wider than the spacing S of strips 26, and could extend along the entire width of lower layer 14 if desired. Cutout 28 may be formed in lower layer 14 according to any known procedure.

According to the invention, a force is applied by lifting mechanism 36 to extending portion 30 of upper lip portion 22 in a direction substantially away from lower lip portion 24 whereby lower lip portion 24 is held in place by strips 26 and upper lip portion 22 is displaced away from lower lip portion 24, thereby opening bag opening 20 of bag 10 in accordance with the invention.

Figure 3:
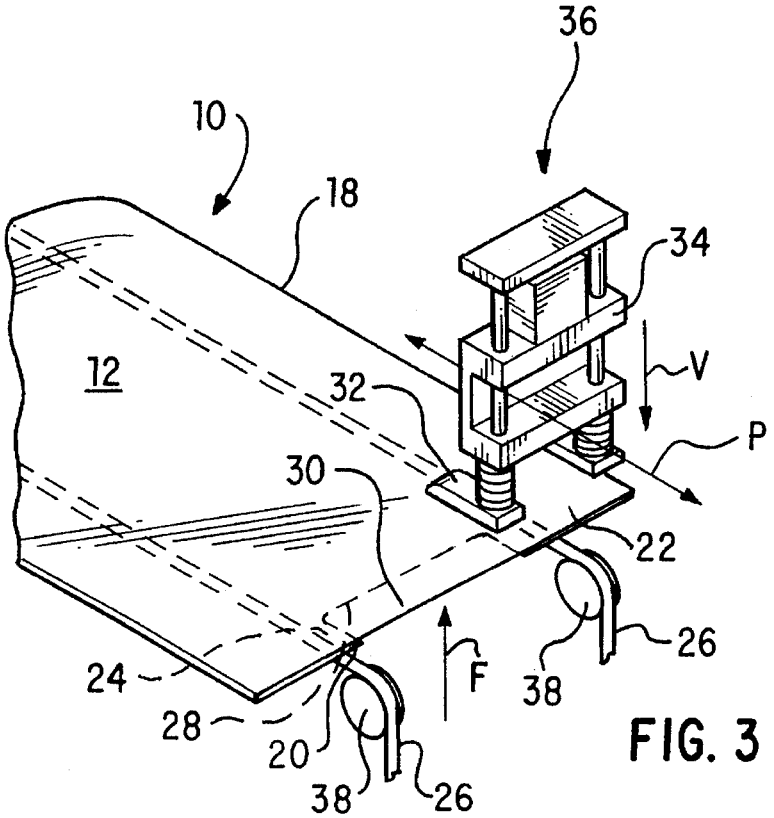
FIG. 3 is a perspective view of a first bag opening system according to the invention.

Referring now to FIGS. 3 and 4, arm members 32 on lifting mechanism 36 are provided for applying the desired force F (See also FIG. 8) to portion 30 of bag 10 so as to open bag 10 in accordance with the invention. According to the invention, arms 32 are preferably moveable in a substantially vertical or perpendicular direction relative to a bag 10 positioned on strips 26 according to the invention, as indicated by arrows V. Further, arms 32 may preferably be movably mounted to a carriage 34 or other member which is moveable in a direction substantially parallel to the direction or path of advance of strips 26 as indicated by arrows P. Any means 35 known in the art may suitably be utilized according to the invention for providing the desired movement of arm members 32 and carriage 34 as illustrated schematically in FIGS. 5–8. Further, vertical and parallel movement of arm members 32 may both be provided through carriage 34, or through any other suitable structure so as to provide the desired degrees of movement of arm members 32.

As shown in the drawings, two substantially parallel and spaced arm members 32 may be provided. Arm members 32 are preferably spaced at a spacing less than spacing S of strips 26 and less than width W of cutout 28 so that arm members 32 may readily pass between strips 26 and through cutout 28 during the opening or force applying step of the bag opening method of the present invention.

Referring now to FIGS. 5–8, the steps of the method of the present invention are further described.

Figure 6:
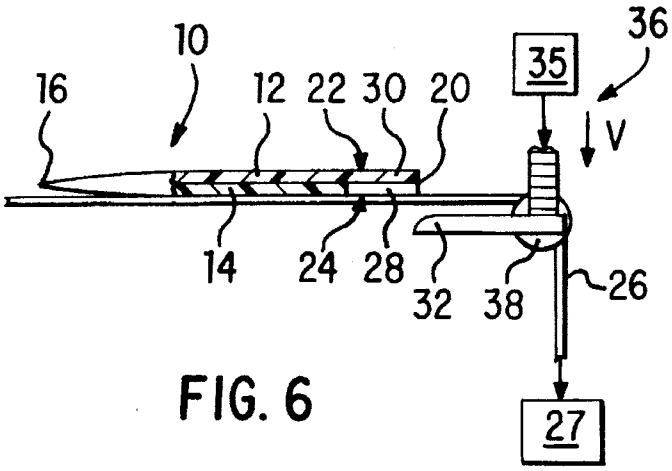
FIGS. 5–8 are side sectional views of a system according to the invention in various stages of opening a bag according to the method of the present invention.
Figure 5:
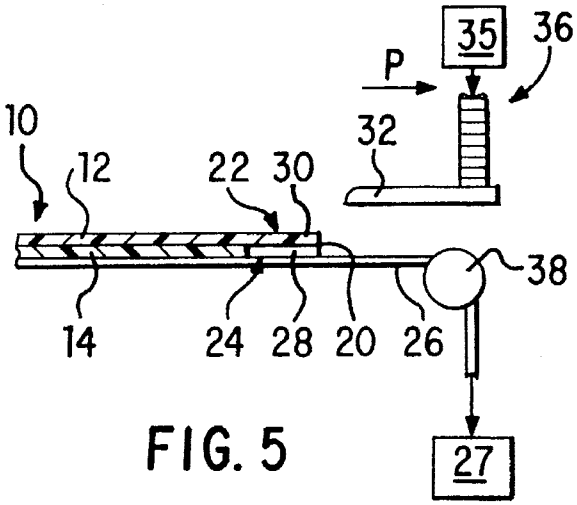
Figure 8:
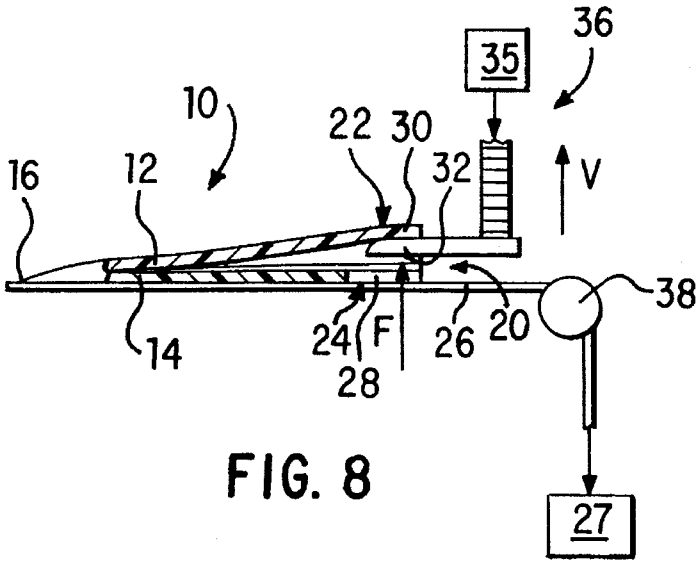
Figure 7:
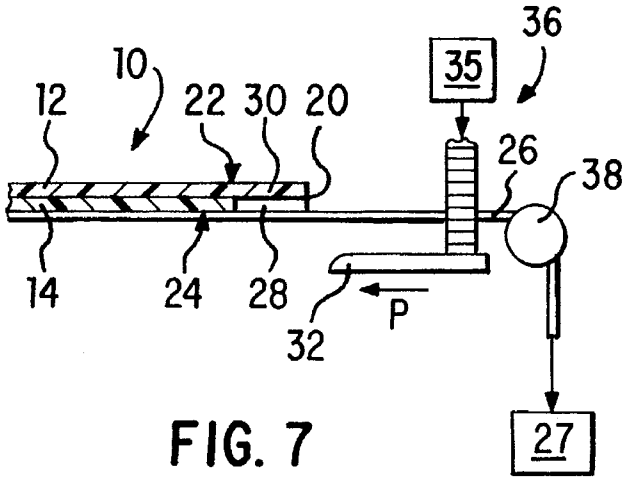

Initially, bags 10 are positioned on strips 26 as described above with each bag opening 20 in a leading position. Bags 10 and strips 26 are advanced toward lifting mechanism 36 so as to position bag opening 20 of a bag 10 for opening. According to the invention, arm members 32 are positioned from a starting position indicated in FIG. 5 to a position below strips 26 and bag 10 or, in other words, to the lower layer 14 side of bag 10 as shown in FIG. 6. Arm members 32 are then advanced relative to bag 10 so as to position arm members 32 below portion 30 and cutout 28 as shown in FIG. 7. Arm members 32 are then lifted according to the invention so that arm members 32 pass through cutout 28 and contact portion 30 of upper lip portion 22. Further lifting of arm members 32 to the position illustrated in FIG. 8 above strips 26 results in application of force F to upper lip portion 22, lifting of upper lip portion 22 away from lower lip portion 24 which remains adhered to strips 26, and the opening of bag opening 20. Advantageously, the bag opening method of the present invention is carried out without the use of air pressure, vacuum and the like, and while minimizing the previously experienced problem of sticking between lips 22, 24 of bag opening 20. At this point, a product (not shown) can be inserted into bag 10. Arm members 32 can preferably be withdrawn from bag 10, to the starting position of FIG. 5, and loaded bag 10 removed to the next station for further processing according to conventional techniques which form no part of the present invention. The next bag 10 to be opened is then advanced and the method repeated as desired.

Rollers 38 or any other suitable structure can be provided if desired for rolling up advanced strips 26 or for guiding strips 26 to a discarding or recycling station.

Figure 9:
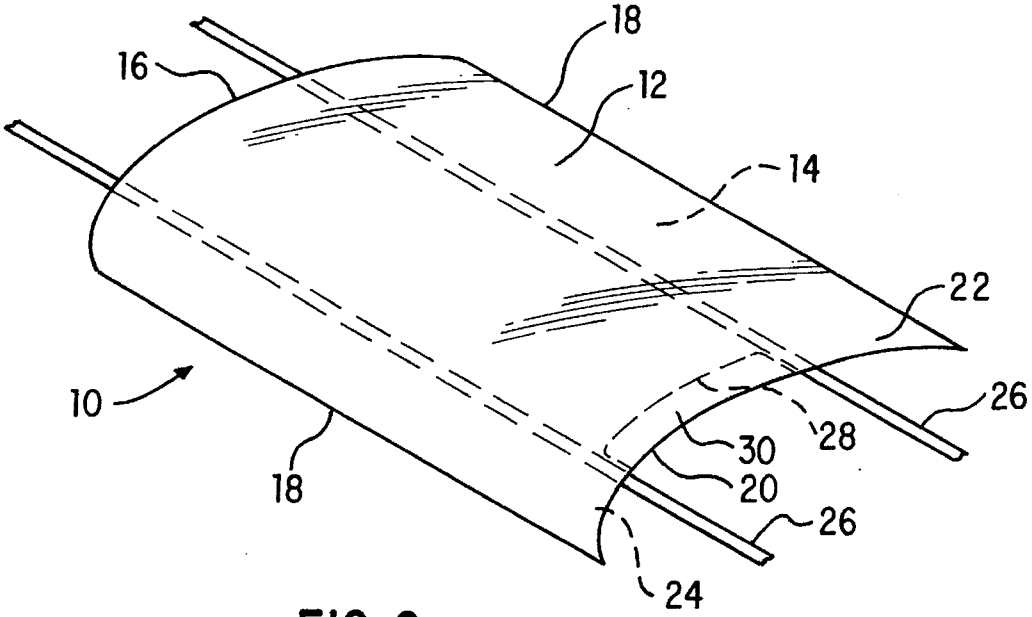
FIG. 9 is an alternate embodiment of a bag positioned on adhesive strips according to the invention.

It should be noted that the present method and system of opening bags is readily applicable to bags made from a wide variety of materials and bags of various shapes. Bags 10 may be made from any desired material. Further, while FIGS. 1 and 2 illustrate straight seal bags, that is bags having a substantially straight bottom edge 16 and bag opening 20, bags 10 could be provided with curved bottom edges 16 and bag openings 20 as illustrated in FIG. 9. In this configuration, cutout 28 may be curved to match the contour of bag opening 20 if desired, or cutout 28 may be straight as in FIGS. 1 and 2, all within the scope of the present invention.

Figure 10:
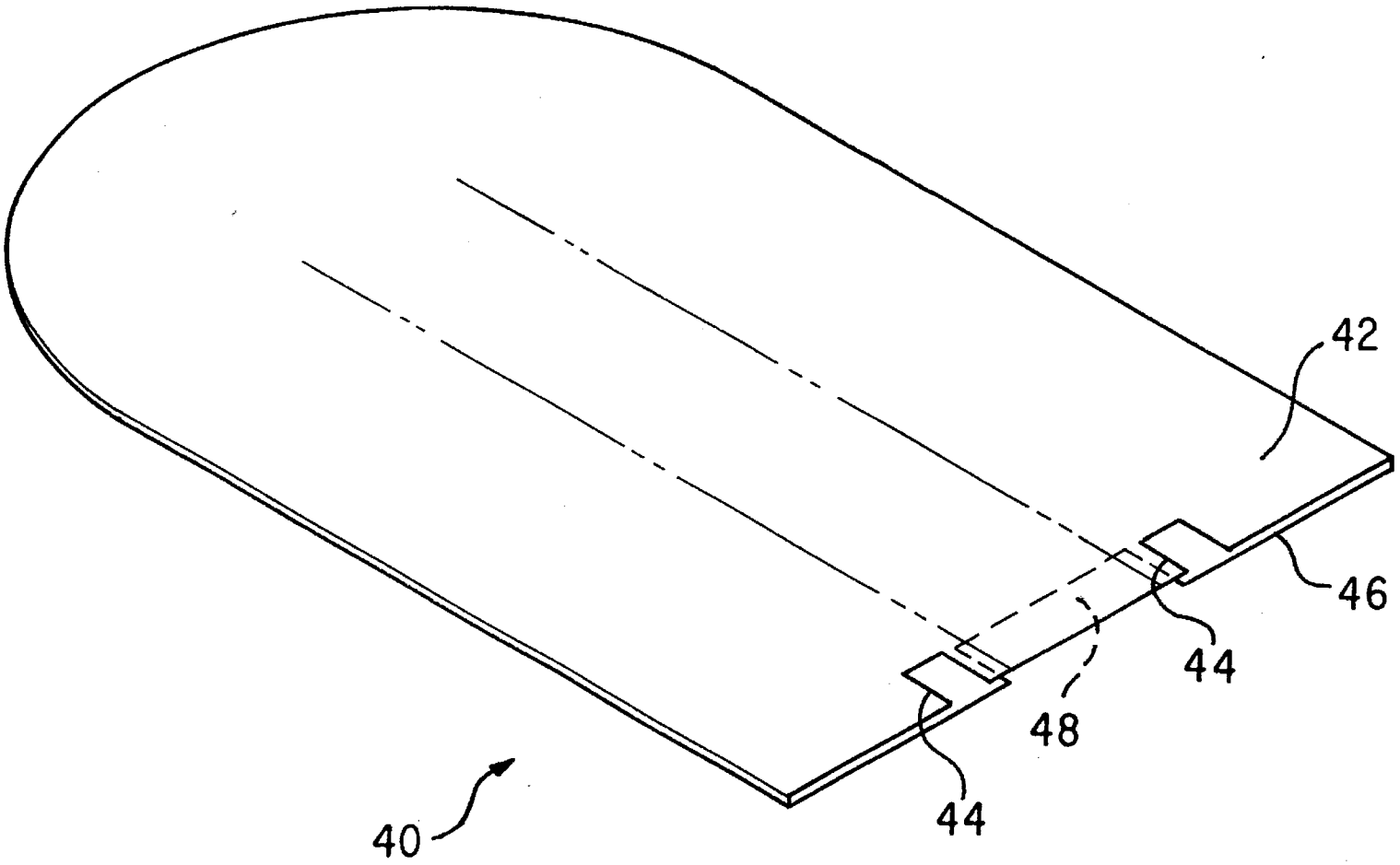
FIG. 10 is a perspective view of a second embodiment of a bag positioned on adhesive strips of tape according to the invention.
Figure 11:
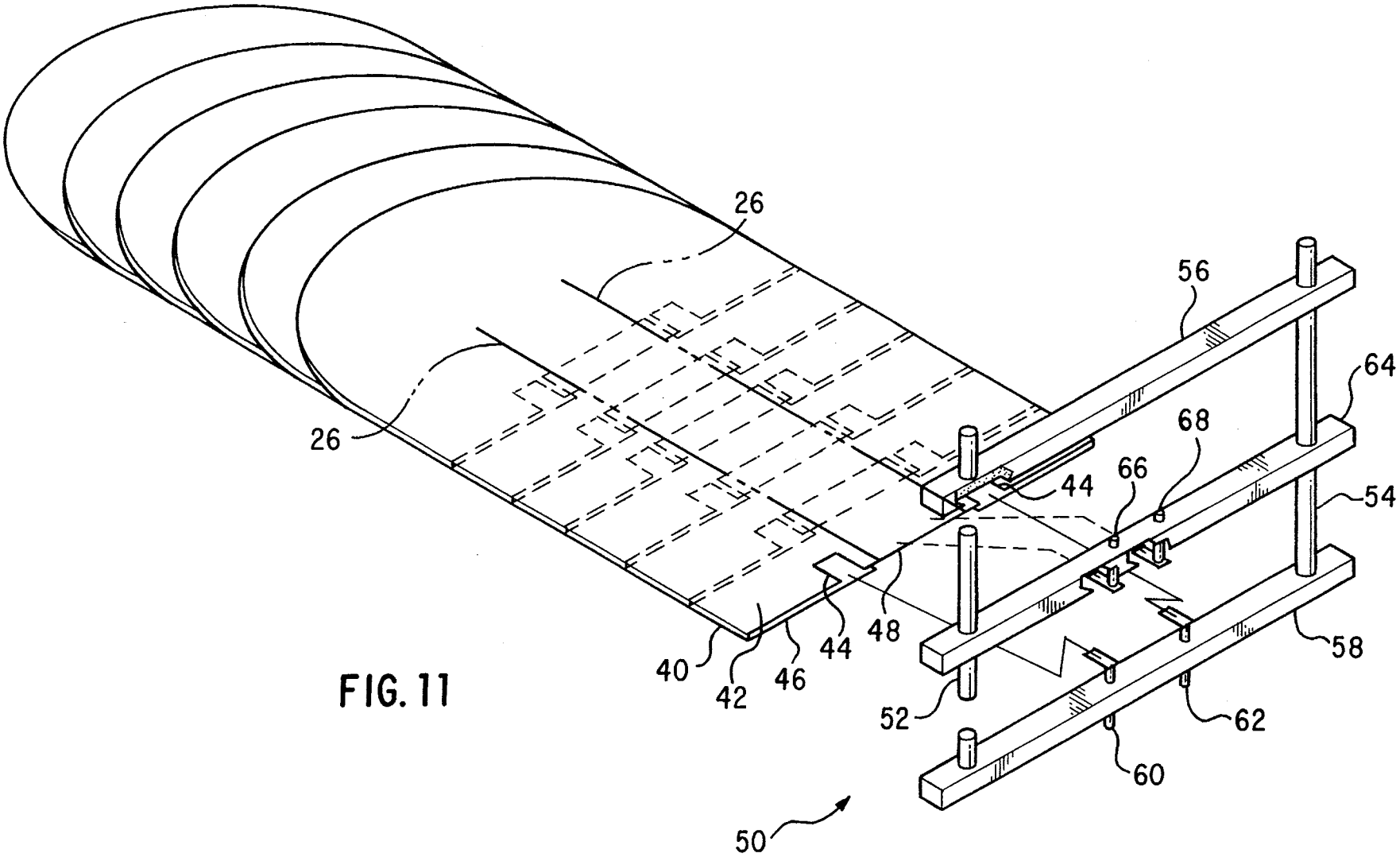
FIG. 11 is a perspective view of a second bag opening system according to the invention.

An alternate bag system is illustrated in FIGS. 10 and 11 a bag 40 consisting of a top lip 42 and bottom lip 46 with the top lip 42 having one or more partial offsets or cutout portions 44 exposing the bottom lip 46 and the bottom lip 46 having a one or more partial offsets as cutout portions 48 exposing the top lip 42 may be opened with the device 50 shown in FIG. 11. The device 50 consists of two circular rails 52 and 54 held equidistant by a stationary top block 56 and a stationary bottom block 58, the bottom block 58 having two clamps 60, 62 which are moved vertically relative to block 58. In addition the device has an intermediate block 64 which may move along rails 52, 54 and has two clamps 66, 68 which is moved vertically relative to intermediate block 64. By moving the intermediate block 64 towards the bottom block 58 and indexing the bag 40 towards the device 50 the partial offsets 44, 48 in the bag lip may be aligned with the bag clamps 60, 62, 66, 68. After closing the clamps which secures the top and bottom lips the intermediate block 64 is moved toward the top block 56 along rails 52, 54 moving the top lip 42 away from the bottom lip 46 for opening the bag 40.

Thus disclosed is a method and system of opening a bag wherein bags are reliably opened without the use of air pressure or vacuum, and the sticking of lips of the bag opening is minimized or eliminated altogether.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A method of opening a bag, comprising the steps of:

providing a plurality of bags, each bag comprising a first layer having a first lip and a second layer having a second lip, said first lip and second lip defining a substantially fiat bag opening, and said first lip having a cutout defining an extending portion of said second lip which extends beyond said first lip;

positioning said plurality of bags on an adhesive strip for advancing said bags along a path by adhering said first lip of each bag to said adhesive strip so that said bag opening is positioned transverse to said path and at a leading edge of said bag with respect to a direction of advance of said bag along said path;

advancing said plurality of bags along said path toward a bag opening means; and displacing said bag opening means through said cutout into contact with said extending portion so as to displace said second lip away from said first lip along the entire width of said first and second lips, thereby opening said bag opening.

2. A bag opening system, comprising: a plurality of bags, each bag having a first lip and a second lip defining a substantially flat bag opening, said second lip having an extending portion extending beyond a portion of said first lip, but not beyond the first lip along the entire width of said first lip wherein said first lip has a cutout defining said extending portion of said second lip;

means for positioning said plurality of bags in a row, said bags being positioned with said first lip attached to said positioning means and with said bag opening positioned transverse to said row;

opening means for contacting said extending portion of said second lip so as to displace said second lip away from said first lip along the entire width of said first and second lips and open said bag opening, and wherein said opening means passes through said cutout to contact said extending portion; and means for advancing said positioning means so as to advance said plurality of bags to said opening means.

3. A bag opening system according to claim 2, wherein said means for positioning said bags comprises at least one adhesive strip, said first lip of each bag being adhered to said strip.

4. A bag opening system according to claim 3, wherein said means for positioning said bags comprises two substantially parallel spaced adhesive strips.

5. A bag opening system according to claim 4, wherein said two spaced adhesive strips are spaced at a tape spacing and wherein said cutout is narrower than said tape spacing.

6. A bag opening system according to claim 2, wherein said opening means comprises at least one arm member movably positioned relative to said positioning means between a ready position wherein said arm member is on one side of said positioning means and an opening position wherein said arm member is on the other side of said positioning means.

7. A bag opening system according to claim 2, wherein said opening means comprises a carriage adapted for movement in a first direction substantially parallel to said positioning means and at least one arm member mounted to said carriage for movement in a second direction substantially perpendicular to said positioning means.

* * * * *